United States Patent [19]

Liska et al.

[11] 4,350,921

[45] Sep. 21, 1982

[54] DRIFT TUBE SUSPENSION FOR HIGH INTENSITY LINEAR ACCELERATORS

[75] Inventors: Donald J. Liska; Roger G. Schamaun; Donald C. Clark; R. Christopher Potter; Joseph A. Frank, all of Los Alamos, N. Mex.

[73] Assignee: The United States of America as represented by the United States Department of Energy, Washington, D.C.

[21] Appl. No.: 129,299

[22] Filed: Mar. 11, 1980 (Under 37 CFR 1.47)

[51] Int. Cl.[3] ..... H05H 9/00

[52] U.S. Cl. ..... 313/360.1; 315/5.41

[58] Field of Search ..... 313/360.1, 361.1; 315/5.41, 5.42, 5.46

[56] References Cited

U.S. PATENT DOCUMENTS 3,710,163 1/1973 Bomko et al. ..... 313/360

*Primary Examiner*—Eli Lieberman

*Attorney, Agent, or Firm*—Robert W. Weig; Paul D. Gaetjens; Richard G. Besha

[57] ABSTRACT

The disclosure relates to a drift tube suspension for high intensity linear accelerators. The system comprises a series of box-sections girders independently adjustably mounted on a linear accelerator. A plurality of drift tube holding stems are individually adjustably mounted on each girder.

3 Claims, 5 Drawing Figures

DRIFT TUBE SUSPENSION FOR HIGH INTENSITY LINEAR ACCELERATORS

This invention is a result of a contract with the U.S. Department of Energy (contract W-7405-ENG-36).

BACKGROUND OF THE INVENTION

Recently it has become desirable to construct a high intensity linear accelerator for producing a 100 mA continuous duty deuteron beam to a flowing liquid lithium target. Machines of this type are needed as neutron factories for the testing and development of metals to be applied to the first wall in future fusion energy power generating stations. They are also useful in a branch of the fusion energy program known as inertial confinement which requires heavy ion accelerators. Because the beam will render a drift tube linac radioactive, it should be structured so that alignment and maintenance will not require manned entry into the tanks. The accelerator will provide unprecedented continuous duty power and beam intensity and should have a functional life of at least about 20 years. A 100 mA deuteron beam will be fired at either 20 or 35 MeV into a rapidly flowing lithium target that must be exposed directly to the beam without the aid of an isolation window.

Previous accelerators have either operated at a low duty factor by pulsing the beam or they operated at continuous duty with a low intensity beam. In all cases the net loss of beam was low enough to allow maintenance of the machine to be carried out by hands on methods. In certain circular machines, the beam extraction devices could not be well protected from beam losses and achieved a level of activity that finally rendered the machines dangerous from a maintenance standpoint.

A deuteron beam, by virtue of the bound neutron, is a highly activating beam. Such machines in the past have been forced to operate at low duty to prevent activation of the accelerator's structure. Solution of the hands on maintenance and alignment problem is an important step to raising the duty factor of deuteron accelerators.

SUMMARY OF THE INVENTION

In accordance with the invention there is provided a drift-tube suspension apparatus for linear accelerators comprising a plurality of box-section suspension girders. Attached to each of the girders is a plurality of drift tubes on stems having longitudinal axes of rotation, a drift tube being attached to the lower end of each of the stems. The other end of each stem is supported by a clamping mechanism on the girder. Alignment devices are provided for rotating drift-tube stems and for moving them in "X," "Y" and "Z" directions. Radiofrequency degradation resistant vacuum sealing bellows provide a seal about each stem. Sighting devices are provided for aligning a plurality of the girders on a linac housing.

One object of the invention is to separate alignment of drift tubes from the vacuum sealing function in accelerator structures.

Another object of the invention is to provide for precision alignment of drift tubes within accelerator housings without requiring entry into the housings themselves.

One advantage of the present invention is it is adaptable to new generation high intensity accelerators which have serious radioactivation problems.

Another advantage of the invention is that it utilizes a girder-strong back for drift-tube suspension in clusters and does not expose the girder to tank vacuum forces.

Another advantage of the instant invention is that drift tubes can be aligned externally under vacuum conditions to within about ±0.001 inch.

Still another advantage is that the bellows providing vacuum sealing for the drift tubes form radiofrequency choke joints so that radiofrequency power cannot enter, erode and eventually destroy them.

Yet another advantage of the instant invention is that the drift tubes are isolated from the accelerator housing so that if the accelerator housing distorts, the alignment of the drift tubes is not disturbed.

DETAILED DESCRIPTION OF THE PREFERRED EMBODIMENT OF THE INVENTION

Figure 1:
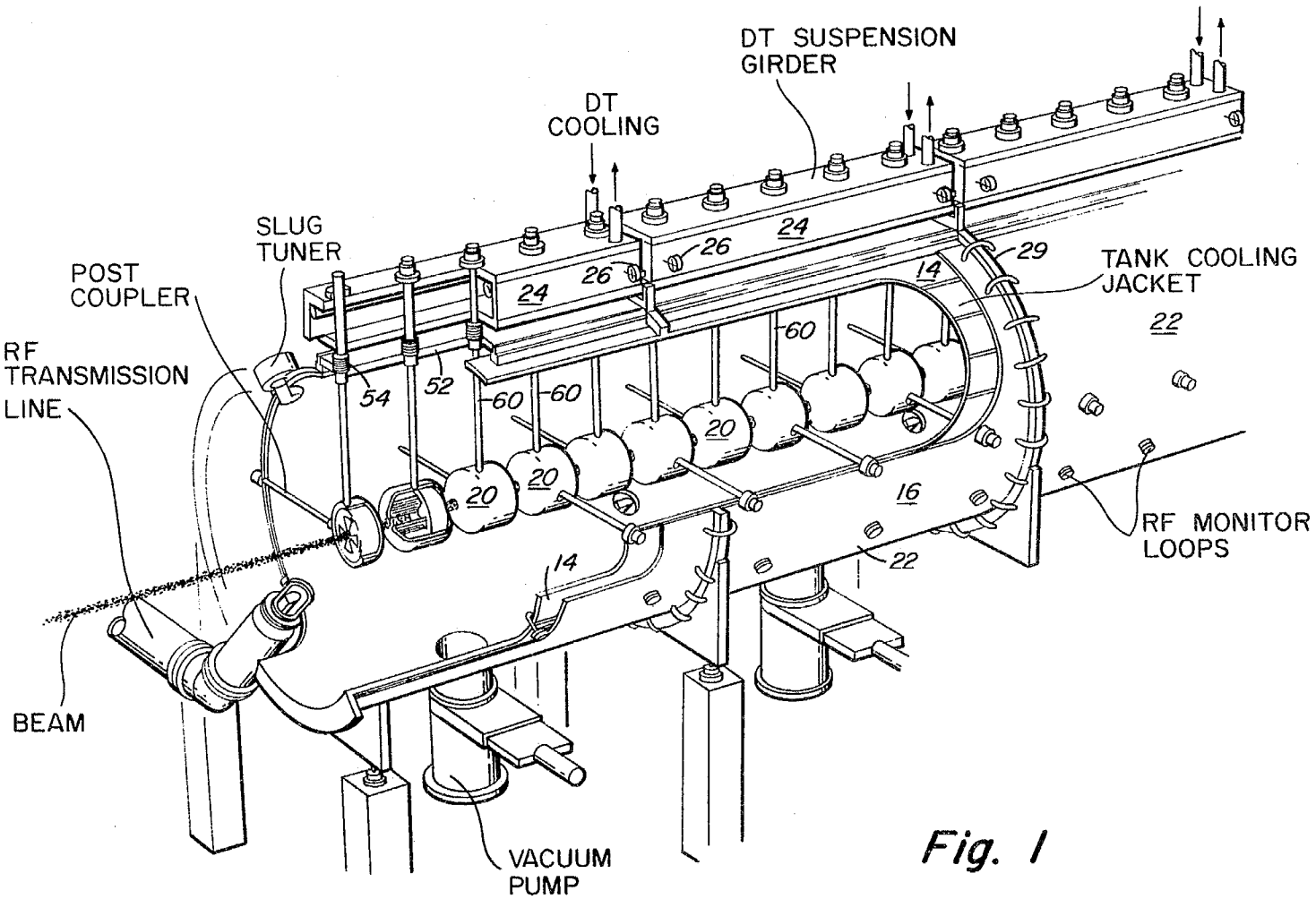
FIG. 1 is a cutaway perspective view of a portion of a linac accelerator incorporating the drift tube suspension apparatus of the invention.
Figure 2:
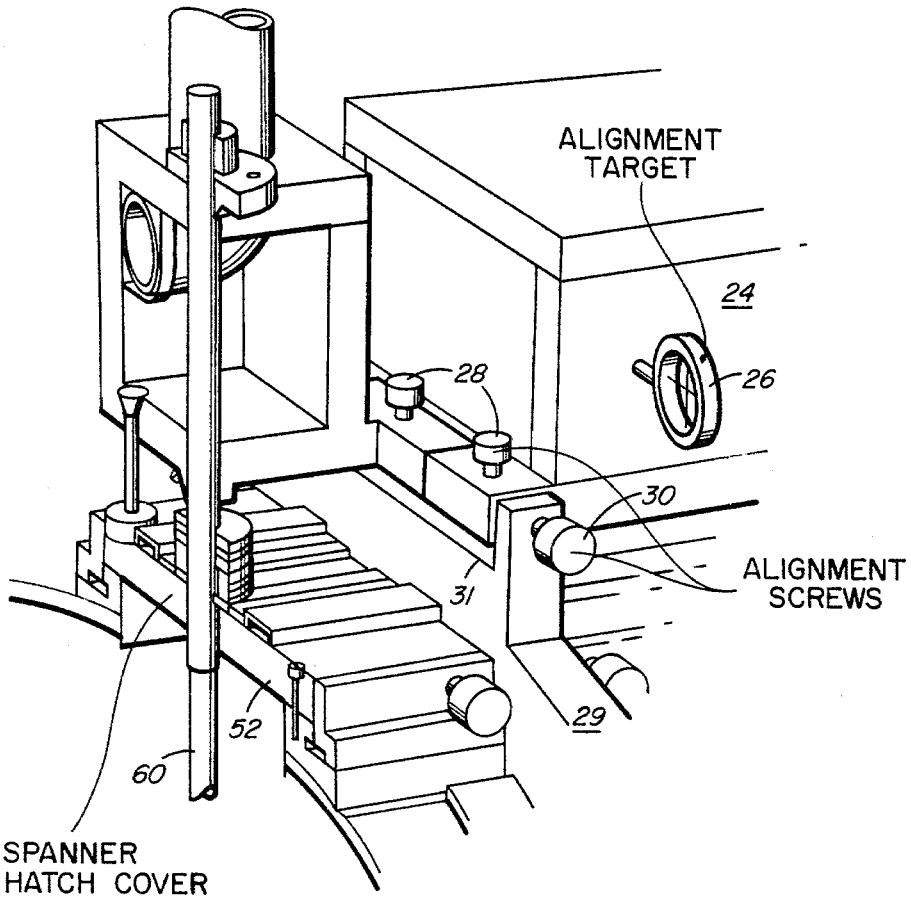
FIG. 2 is a cutaway perspective view of the suspension of one drift tube stem suspension and suspension girder.
Figure 3:
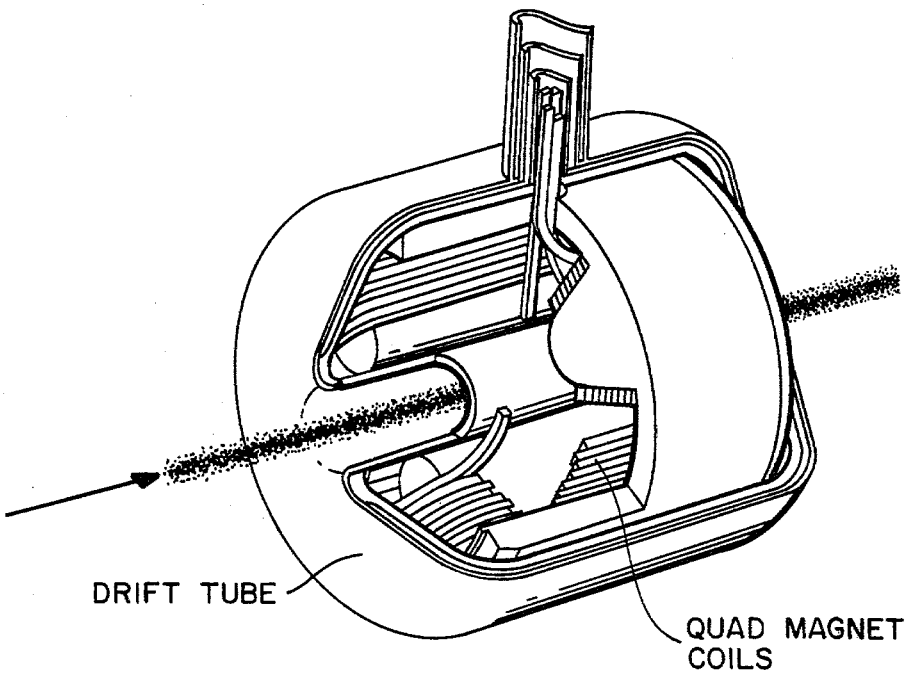
FIG. 3 is a cutaway view of a drift tube.
Figure 4:
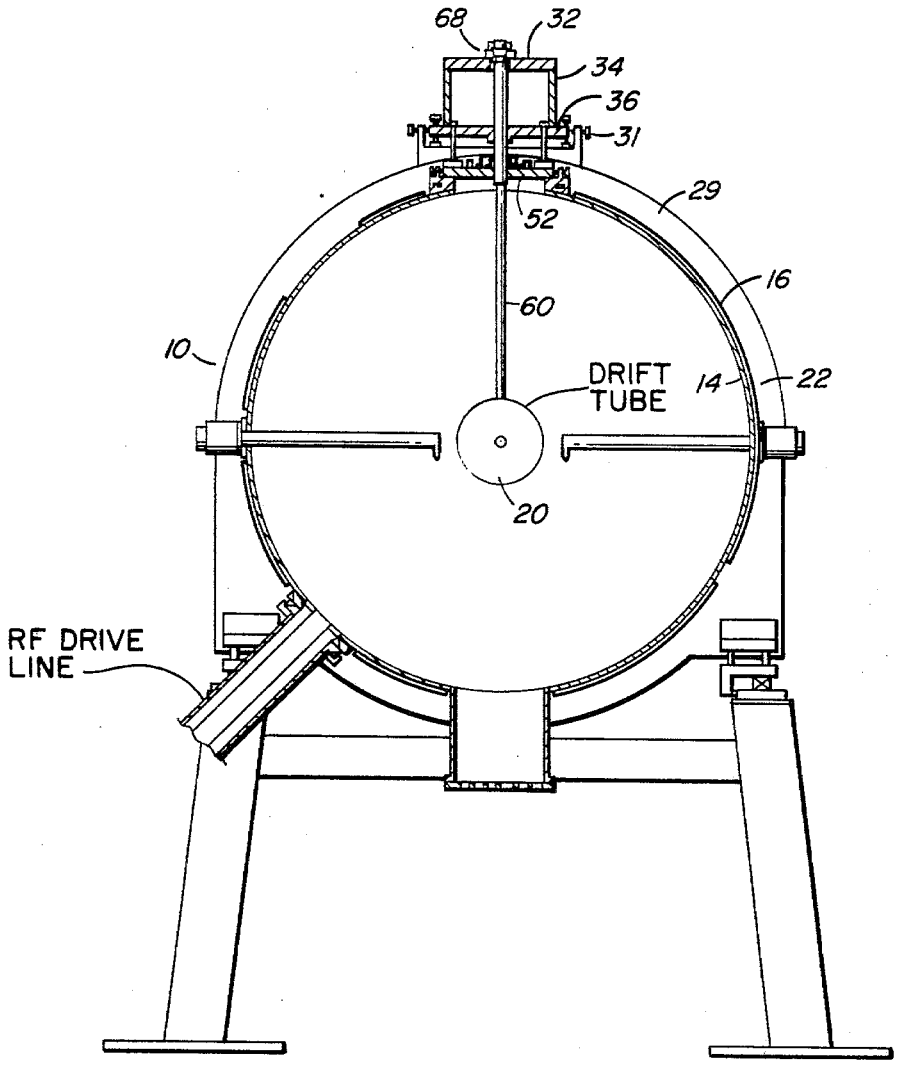
FIG. 4 is a cutaway view of a portion of the accelerator showing a drift tube suspension in position thereon.

Reference is now made to FIG. 1 which shows a cutaway perspective view of structure on a drift tube linac accelerator housing providing a preferred embodiment of drift tube suspension in accordance with the invention. A drift-tube linac 10 comprises two continuous tank sections 18 and 15 m long, joined by an intertank spacer. The tanks are driven by 7 and 6 high-powered rf coupling loops, respectively, each capable of delivering 500 kW at 80 MHz. Because the radiofrequency systems for each tank are independent, the downstream tank can be shut down when a 20 MeV beam is used. Diagnostics are located in the intertank spacer that is 1 beta-lambda in length, i.e., 54.3 cm at 20 MeV. The tanks are fabricated of 2.5-cm-thick copper clad steel 14 surrounded by a continuous steel shell jacket 16 for longitudinal counterflow cooling. High radioactivation levels are achieved in the tank by beam spill occurring within the drift tube bores. Therefore, a man should never enter the tanks. The drift-tube linac is described in detail in Donald J. Liska et al., "Design of Accelerating Structures for FMIT," 1979 Particle Accelerator Conference, San Francisco, Calif., Mar. 12–14, 1979; Donald J. Liska et al., "Modular Design Aspects of the FMIT Drift Tube Linac," 1979 Linear Accelerator Conference, Montauk, N.Y., Sept. 9–14, 1979; and Edwin L. Kemp, Jr. et al., "The Fusion Materials Irradiation Test (FMIT) Accelerator," 1979 Linear Accelerator Conference, Montauk, N.Y., Sept. 9–14, 1979. The accelerator can advantageously usilize the girder-strongback 18 drift tube suspension of the invention because the drift tubes 20 can be maintained in accurate alignment as well as being aligned prior to installation within tanks 22 without a man entering the tanks. Prior to installation, a selected plurality of drift tubes 20 are aligned on a particular suspension girder 24. After installation the various suspension girders 24 can be aligned using alignment targets 26 and alignment screws 28 and 30 seen in FIG. 2, for alignment relative to one another. In the preferred embodiment, each girder 24 is about 3 m long, weighs about 3000 kg and carries from 3 to 14 drift tubes. As seen in the FIG. 5 embodiment, each girder 24 comprises a top section 32 and walls 34. The girder is supported atop tank housing 22 on base platform 36 affixed thereto by gussets 18. Girder 24 is supported on accelerator tank housing 22 by a suspension system 40 comprising X-direction adjustable slide 42 and Z-direction adjustable slide 44 each of which are supported on belleville spring washers 46. This is slightly different from the FIG. 2 embodiment. Tank 22 comprises a series of cylindrical sections each having an open slot defined by walls 48 running down the top. Tank 22 is sealed vacuum tight along this slot to spanner hatch cover 52 by metal O-rings 50. A bellows 54 is vacuum sealed on spanner hatch cover 52 and about a drift-tube stem 60 by O-ring 62. Bellows 54 is attached to spanner hatch cover 52 by bolts 64, and importantly and significantly provides a choke joint which eliminates radiofrequency degradation of the bellows to drift stem seal. Spanner hatch cover 52 is bolted to tank 22 by bolts 66. Drift-tube stems 60 are suspended from "X," "Y," and "Z" adjustable slide mechanisms 68 mounted on girder top 32 by bolts 70. The drift-tube stems are cooled by water passing through inlet 72, within stem 60, and out of outlet 71. Drift tubes 20 are suspended in the tank on drift-tube stems 60 as seen in FIG. 1 and are alignable relative to one another on a particular girder by the adjustable slide mechanisms 68. The girders are aligned relative to one another by the alignment means 28 and 30 of FIG. 2 or the slide mechanisms 40 of FIG. 5 which are mounted on tank stiffening rings 29. Details of the drift tube structure seen in FIG. 3 are described in the previously noted publications.

The ball bushing 73 and clamp 75 assembly holds the drift tube firmly in all directions except "Y" or vertical. This provides for vertical adjustment in response to any thermal expansion without applying any stress to the drift tube stem.

Figure 5:
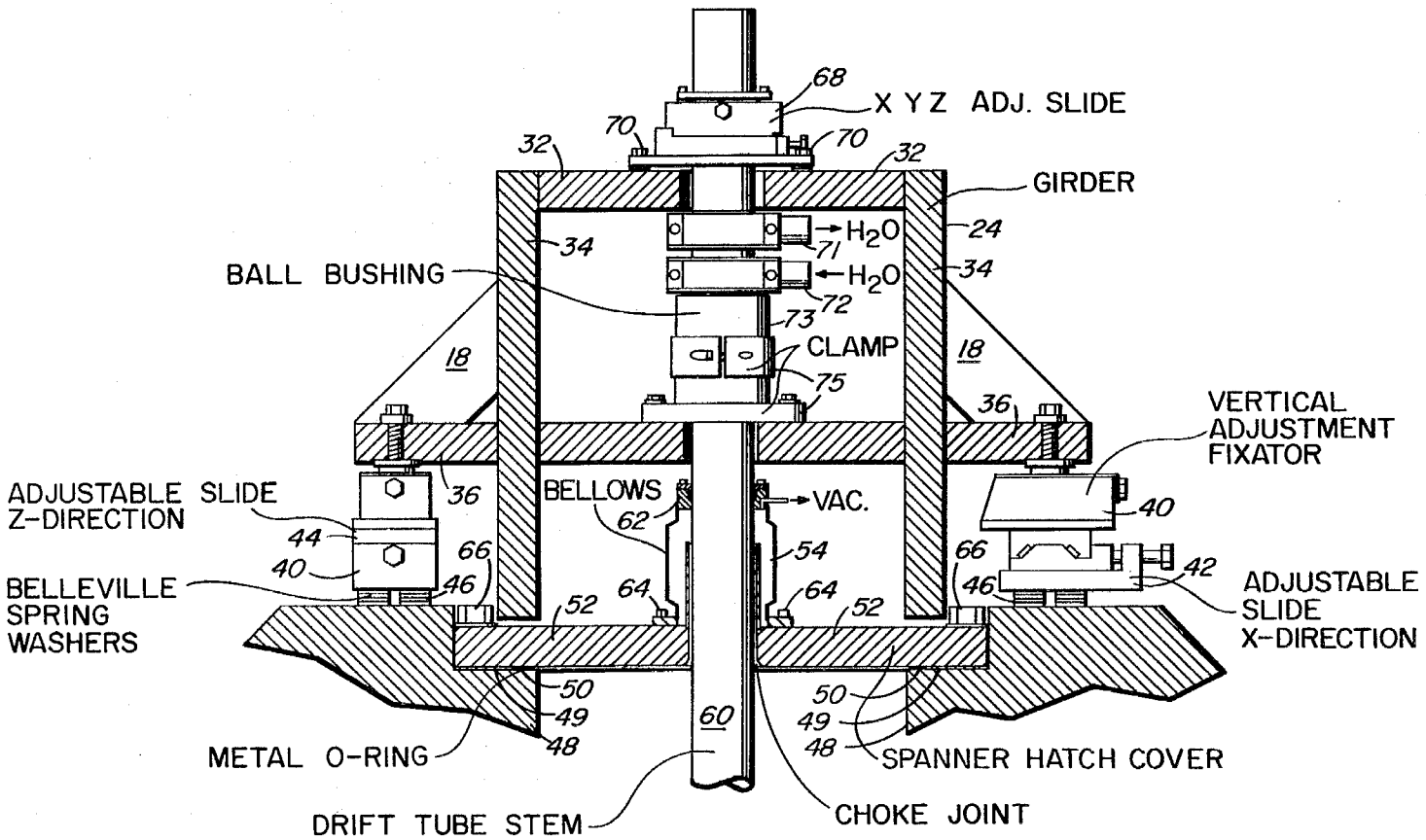
FIG. 5 is a cutaway view of a preferred embodiment of the drift tube suspension system of the invention.

The adjustable suspension system 40 of FIG. 5 provides for adjustment in two directions ("X" and "Y" or "Z" and "Y") at three locations and allows thermal expansion in the other direction. One of the four supports for each girder is adjustable in the "Y" direction only and can float in all other directions.

Adjustable slide mechanisms 68 adjust against compressed springs in the "X" and "X" directions, independently. The "Y" direction is adjusted by shims. No adjustment has any effect on any other adjustment. The shims may be adjustable, e.g., Belleville springs. Many available and well-known "X," "Y," "Z" slidably adjustable devices may be used. Devices 40 and 68 are exemplary only and the invention is not limited thereto.

It is significant that the girders 24 are supported by the tank stiffening rings 29 and not by vacuum sealing surfaces 49. This eliminates any warping that may be induced in the girders when the tanks are evacuated or powered. The invention incorporates a separate spanner hatch cover 52 that provides vacuum and radiofrequency seals as well as bridging and strengthening for the tank slot. Because cover 52 never directly contacts drift-tube stems, slot warpage caused by vacuum or thermal pressures on the tank cannot affect drift-tube alignment. The only forces acting on the drift-tube stems are applied by the bellows 54 that form the vacuum seal between spanner base plate 52 and stems 60. These forces are relatively small and directed principally along the stems. The gross alignments of the girders relative to one another are affected only by warpage of the stiffening rings 29, which are very small. If this misalignment does happen to become excessive, external adjustments of the slide mechanisms 31 or 40 by which the girders are supported at each end can correct the problem. A great advantage of the girder-spanner approach is that only girder-to-girder alignment and not drift-tube to drift-tube alignment within a girder is affected by small changes in tank alignment. In the preferred embodiment, alignment targets 26 provide alignment accurate to less than or about ±0.010 in.

Obviously, many modifications and variations of the present invention are possible in light of the above teachings. It is therefore to be understood that within the scope of the appended claims the invention may be practiced otherwise than as specifically disclosed herein.

What is claimed is:

1. A drift tube suspension apparatus for linear accelerators housings comprising:

a plurality of inverted box-section suspension girders;

suspended from each of said girders, a plurality of drift tube stems having longitudinal axes of rotation, a drift tube being attached to one end of each of said stems and each of stems at its other end being supported by said girder;

means for rotating each of said stems about its longitudinal axis of rotation;

means for raising and lowering each of said stems in a first "Y" direction;

means for moving each of said tubes in second and third directions, "X" and "Z";

means comprising radiofrequency degradation resistant bellows disposed about each stem for vacuum sealing said apparatus to said accelerator housing; and means for aligning said plurality of said girders on said housing.

2. The invention of claim 1 wherein said vacuum sealing means comprises a spanner hatch cover comprising choke joints about each stem.

3. The invention of claim 1 wherein said girder alignment means comprises alignment targets.

* * * * *